US005692912A

United States Patent [19]

Nelson et al.

[11] Patent Number: 5,692,912

[45] Date of Patent: Dec. 2, 1997

[54] ELECTRICAL CONNECTOR WITH TERMINAL TAIL ALIGNING DEVICE

[75] Inventors: Richard A. Nelson, Glen Ellyn; Craig A. Bixler, Elmhurst; Glenn A. Landgraf, Naperville, all of Ill.

[73] Assignee: Molex Incorporated, Lisle, Ill.

[21] Appl. No.: 490,502

[22] Filed: Jun. 14, 1995

[51] Int. Cl.[6] ..... H01R 9/09

[52] U.S. Cl. ..... 439/79

[58] Field of Search ..... 439/55, 59, 62, 439/78, 79, 378, 752, 676, 80

[56] References Cited

U.S. PATENT DOCUMENTS

| | | | |
|---|---|---|---|
| 2,994,056 | 7/1961 | Fox | 439/62 |
| 4,173,387 | 11/1979 | Zell | 439/78 |
| 4,200,347 | 4/1980 | Sinclair et al. | 439/79 |
| 4,469,387 | 9/1984 | McHugh | 339/42 |
| 4,533,203 | 8/1985 | Feldman et al. | 439/79 |
| 4,568,134 | 2/1986 | Dimondi | 439/78 |
| 4,583,807 | 4/1986 | Kaufman et al. | 439/79 |
| 4,660,911 | 4/1987 | Reynolds et al. | 439/80 |
| 4,894,026 | 1/1990 | Dixon et al. | 439/609 |
| 4,955,819 | 9/1990 | Harting et al. | 439/79 |
| 4,986,772 | 1/1991 | Fukutani | 439/892 |
| 5,104,326 | 4/1992 | Smith et al. | 439/95 |
| 5,213,514 | 5/1993 | Arai | 439/79 |
| 5,219,295 | 6/1993 | Niwa et al. | 439/79 |
| 5,256,072 | 10/1993 | Hatagishi | 439/79 |
| 5,350,307 | 9/1994 | Takagishi et al. | 439/79 |
| 5,358,413 | 10/1994 | Daly et al. | 439/79 |
| 5,468,154 | 11/1995 | Yip et al. | 439/79 |

FOREIGN PATENT DOCUMENTS

| | | | |
|---|---|---|---|
| 05234646-A | 9/1993 | Japan | H01R 23/68 |
| 06045037-A | 2/1994 | Japan | H01R 23/68 |
| 07057827-A | 3/1995 | Japan | H01R 23/68 |
| 2095485 | 9/1982 | United Kingdom | 439/79 |
| 2219148-B | 11/1989 | United Kingdom | H01R 23/70 |

OTHER PUBLICATIONS

DuPont HPC Bulletin 712, Jan. 1987, Connector System cover page, pp. 6, 12, 15 and 18.

*Primary Examiner*—Gary F. Paumen
*Assistant Examiner*—Tho Dac Ta
*Attorney, Agent, or Firm*—Charles S. Cohen; James C. Paschall

[57] ABSTRACT

An electrical connector includes an elongated dielectric housing having a front mating face and rear face with a plurality of terminal-receiving passageways extending therebetween. The rear face extends between opposite ends of the housing and is devoid of any substantial projections which might prevent a terminal-insertion tool from being moved into proximity with the rear face. A plurality of terminals are received in the passageways. Each terminal includes a forwardly projecting contact portion and a tail portion projecting rearwardly from the housing beyond the rear face thereof. An elongated tail aligning device is mountable on the housing and has a plurality of apertures through which the tail portions of the terminals extend. The tail aligning device has wing portions near opposite ends thereof projecting generally transversely of the rear face of the housing to protect the tail portions of the terminals and to stabilize the connector.

17 Claims, 4 Drawing Sheets

ELECTRICAL CONNECTOR WITH TERMINAL TAIL ALIGNING DEVICE

FIELD OF THE INVENTION

This invention generally relates to the art of electrical connectors and, particularly, to an electrical connector which includes a separate terminal tail aligning device mountable thereon.

BACKGROUND OF THE INVENTION

A known type of input/output (I/O) electrical connector includes an elongated dielectric housing having a front mating face and a rear face with a plurality of terminal-receiving passages extending therebetween. The faces extend between opposite ends of the elongated housing. A plurality of terminals are received in the passages, and each terminal includes a forwardly projecting contact portion and a tail portion projecting rearwardly from the housing beyond the rear face thereof. The housing conventionally includes a pair of generally planar, often triangulated gussets extending rearwardly from the rear face of the housing near the opposite ends thereof and outside the array of terminals. The gussets stabilize the housing and protect the terminals.

The rearwardly projecting gussets on the connector housing create problems during manufacture when the terminals are gang loaded into the passageways in the housing. In particular, these types of connectors are provided in different circuit sizes, and can range from 30 circuits or terminals up to 130 circuits or even more, with as many as nine connector sizes within this range. The terminals are gang loaded into the passageways in the housing by blade-like insertion tools which must fit between the end gussets of the housing. Therefore, different length insertion tools must be provided for each connector size because the gussets prevent the tool blade from being moved into proximity with the rear face of the housing if the tool blade is longer than the spacing between the gussets. This problem is compounded when it is understood that these connectors often have two or more rows of terminals and, consequently, different sizes or lengths of insertion tools must be provided for each size of connector.

Electrical connectors of the character described above often include terminal tail aligning devices. Specifically, the tail aligning devices are mountable on the connector housings and have a plurality of apertures through which the tail portions of the terminals extend. A tail aligning device typically is provided as a flat plastic member having the tail-receiving apertures therethrough and function to maintain the tail portions of the terminals in proper position and spacing.

The present invention is directed to solving the above problems involved in maintaining large inventories of terminal insertion tools and requiring repeated tool changeovers, by a unique system in which the tail aligning device is provided with the protective gussets normally required for such connectors.

SUMMARY OF THE INVENTION

An object, therefore, of the invention is to provide an electrical connector of the character described, with a new and improved tail aligning device.

In the exemplary embodiment of the invention, the electrical connector includes an elongated dielectric housing having a front mating face and a rear face with a plurality of terminal-receiving passageways extending therebetween.

The rear face extends between opposite ends of the housing and is devoid of any substantial projections which might prevent a terminal-insertion tool that extends beyond at least one end of the housing from being moved into proximity with the rear face. A plurality of terminals are received in the passageways. Each terminal includes a forwardly projecting contact portion and a tail portion projecting rearwardly from the housing beyond the rear face thereof. An elongated tail aligning device is mountable on the housing and has a plurality of apertures through which the tail portions of the terminals extend. The tail aligning device has wing portions near opposite ends thereof projecting generally transversely of the rear face of the housing to protect the tail portions of the terminals at least near opposite ends of the housing.

The wing portions of the tail aligning device are provided by generally planar gussets which stabilize the connector. The gussets include generally straight edges engageable with generally flat surfaces at the rear face of the housing. Grooves are formed in the rear face of the housing for receiving the straight edges of the gussets. Complementary interengaging holding means are provided between the tail aligning device and the housing for holding the straight edges of the gussets in abutting engagement with the flat surfaces on the housing.

The connector is disclosed herein as a right-angled connector with the tail portions of the terminals including circuit board mounting portions at angles to the contact portions of the terminals. The circuit board mounting portions extend through the apertures in the tail aligning device. The tail aligning device includes at least one mounting peg adapted for insertion into a mounting hole in an appropriate circuit board. Preferably, the tail aligning device, including the wing portions thereof and the mounting post, is formed as a one-piece molded dielectric component.

A feature of the invention includes complementary interengaging latch means between the tail aligning device and the housing for securing the tail aligning device on the housing. The latch means is interengageable automatically as the tail aligning device is moved to its fully operative position with the tail portions of the terminals in proper position in the apertures of the tail aligning device.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
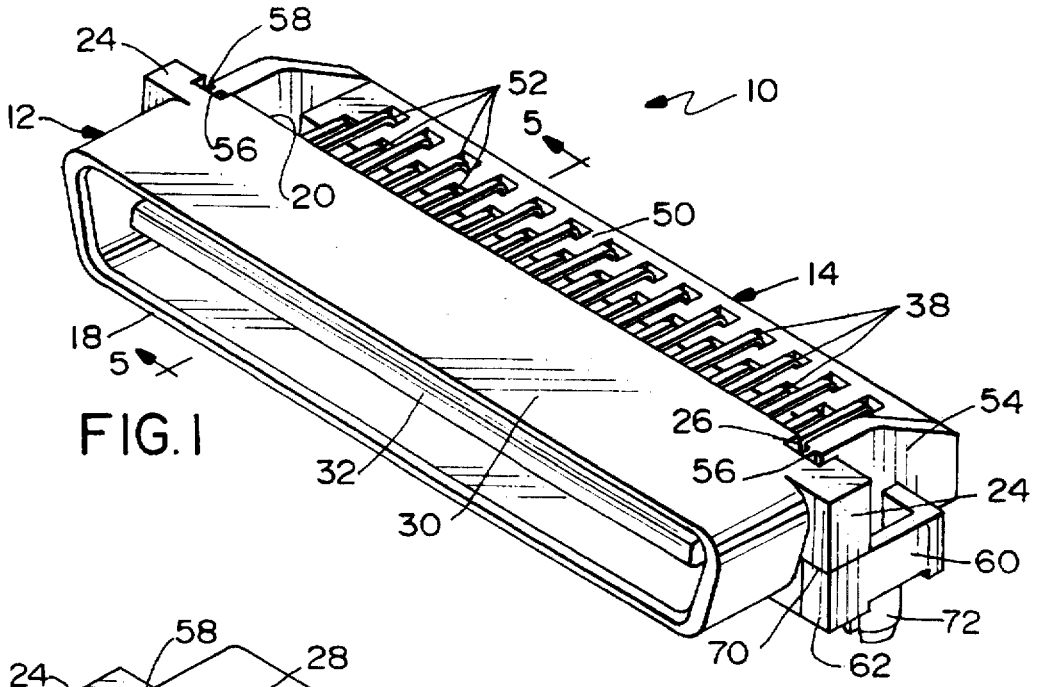
FIG. 1 is a front perspective view of an electrical connector embodying the concepts of the invention.

Referring to the drawings in greater detail, and first to FIG. 1, the invention is embodied in an electrical connector, generally designated 10. As seen best in FIG. 2, the connector generally is formed of two basic components, namely an elongated dielectric housing, generally designated 12, and an elongated tail aligning device, generally designated 14, along with a plurality of terminals, generally designated 16. Each of the housing and the tail aligning device is formed as a one-piece molded dielectric component.

Figure 2:
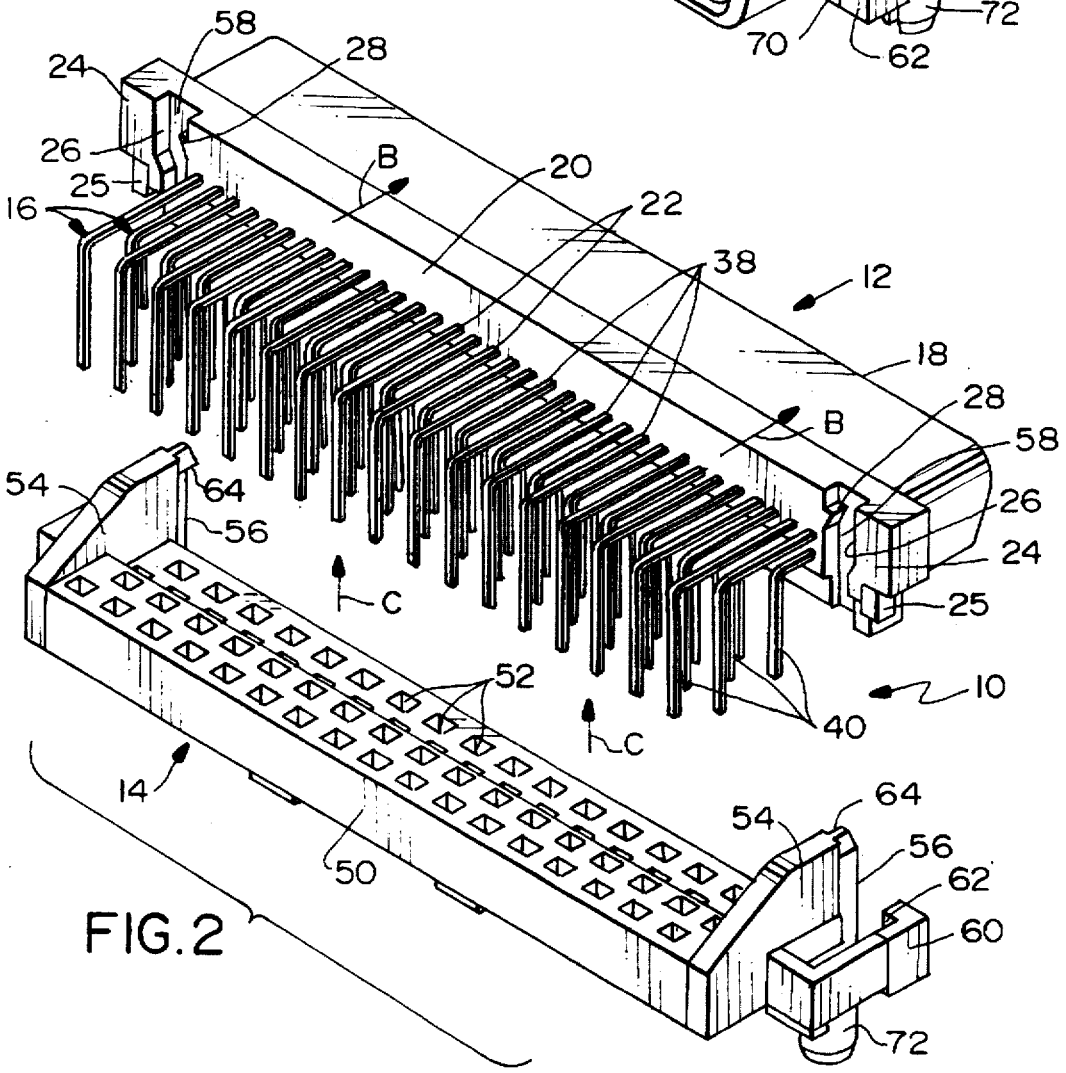
FIG. 2 is an exploded rear perspective view of the housing and tail aligning device of the connector.
Figure 3:
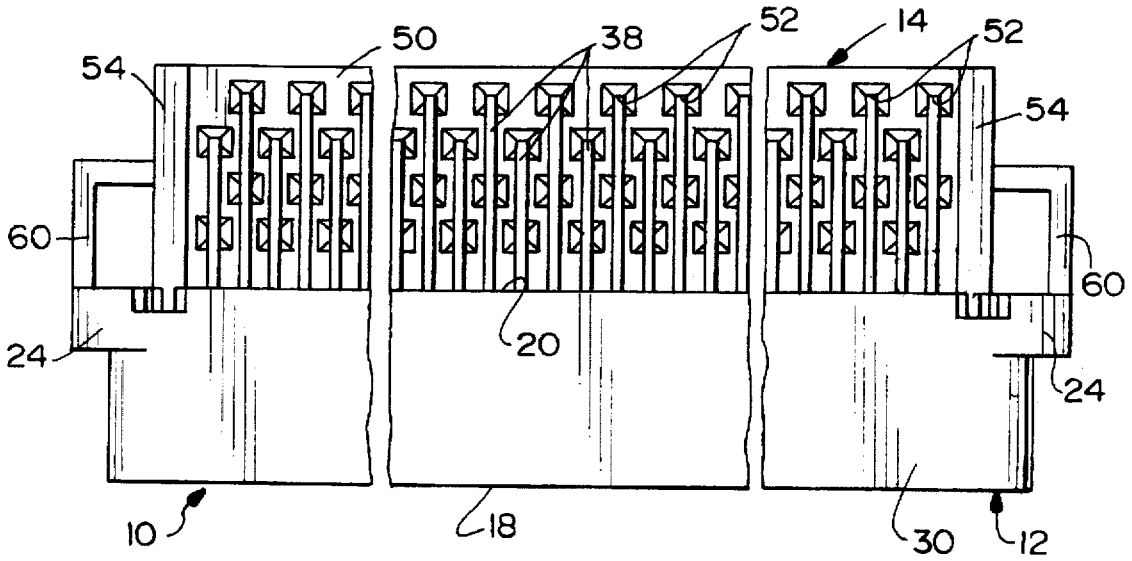
FIG. 3 is a fragmented top plan view of the connector.
Figure 4:
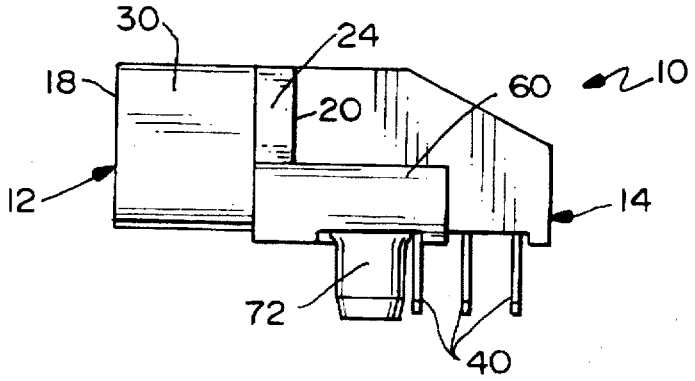
FIG. 4 is an end elevational view looking toward the right-hand end of FIG. 1.

More particularly, referring to FIGS. 3 and 4 in conjunction with FIGS. 1 and 2, elongated dielectric housing 12 has a front mating face 18 and a rear face 20 with a plurality of terminal-receiving passageways 22 (FIG. 2) extending therebetween. Front and rear faces 18 and 20, respectively, of the elongated dielectric housing extend generally between opposite ends 24 of the housing. A pair of grooves 26 are formed in rear face 20 near the opposite ends 24 for purposes described hereinafter. A ramped latch boss 28 is provided within each groove 26, again for purposes described hereinafter.

Figure 5:
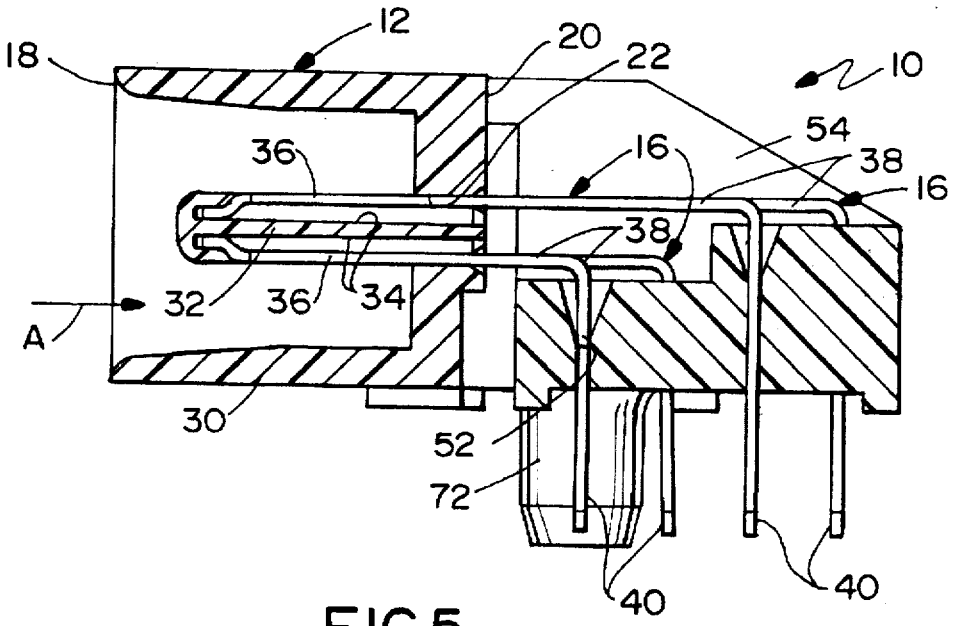
FIG. 5 is a vertical section taken generally along line 5—5 of FIG. 1.

As seen in FIG. 5, front mating face 18 of elongated dielectric housing 12 actually is the front face of a generally hollow shroud 30 which receives a complementary mating receptacle connector (not shown) inserted into the shroud in the direction of arrow "A". An elongated, generally flat tongue 32 projects forwardly within shroud 30. The tongue has a plurality of terminal-receiving grooves 34 on opposite sides thereof.

Still referring to FIG. 5 in conjunction with FIGS. 1–4, each terminal 16 includes a forwardly projecting contact portion 36 and a tail portion 38 projecting rearwardly from housing 12 beyond rear face 20 thereof. Connector 10 is designed as a right-angled electrical connector and, therefore, tail portions 38 of terminals 16 include circuit board mounting portions 40 at right-angles to contact portions 36. The circuit board mounting portions 40 comprise typical solder tails for solder connection to appropriate circuit traces on the circuit board and/or in appropriate holes in the circuit board. Contact portions 36 project into shroud 30 as best seen in FIG. 5, with the contact portions being disposed within grooves 34 on opposite sides of tongue portion 32. When the mating connector is inserted into the shroud in the direction of arrow "A" (FIG. 5), complementary contacts on the mating connector engage contact portions 36 of terminals 16.

The particular array of terminals 16 of connector 10 herein will not be discussed in detail. Suffice it to say, it can be seen particularly in FIGS. 2 and 5 that the terminals are of differing lengths so that circuit board mounting portions (or solder tails 40) are in four rows lengthwise of the connector. Referring specifically to FIG. 2, the terminals are gang loaded, one row at a time, into passageways 22 of connector housing 12 in the direction of arrows "B" (FIG. 2). It can be seen in FIG. 2 that rear face 20 of connector housing 12 is devoid of any substantial projections which might prevent a terminal-insertion tool that extends beyond either end 24 of the connector from being moved into proximity with the rear face. Therefore, longer tools for longer connectors can be used for shorter connectors without any interference by projections at the rear face of the connector housing.

Figure 6:
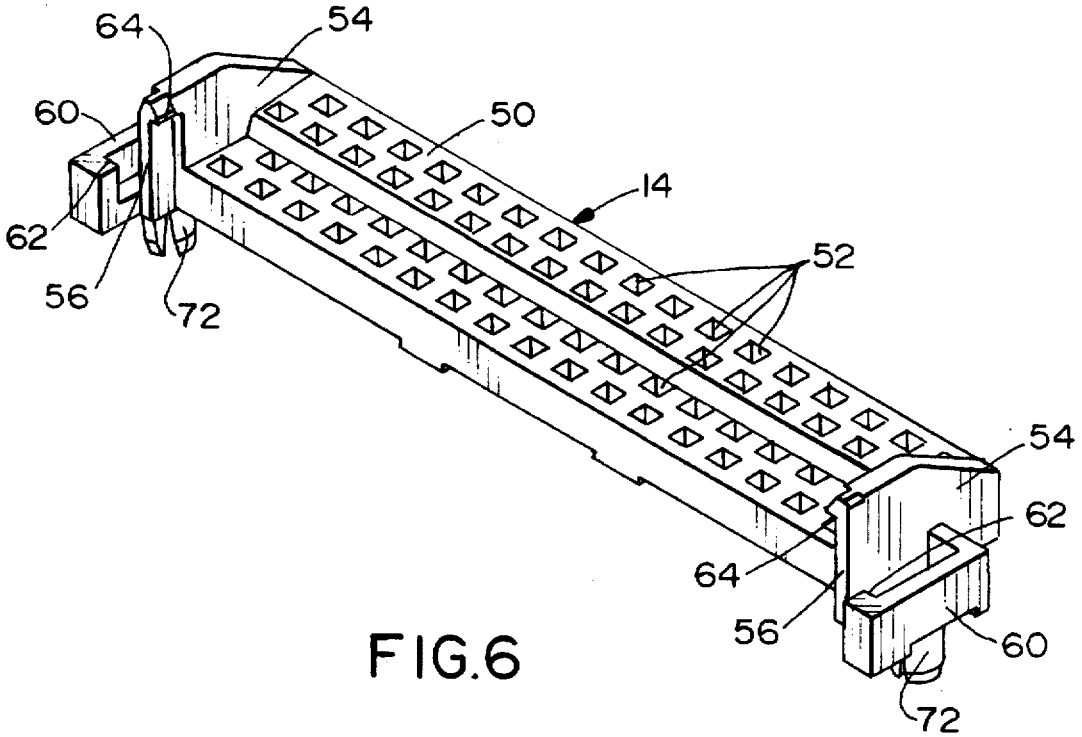
FIG. 6 is a perspective view of the tail aligning device.
Figure 7:
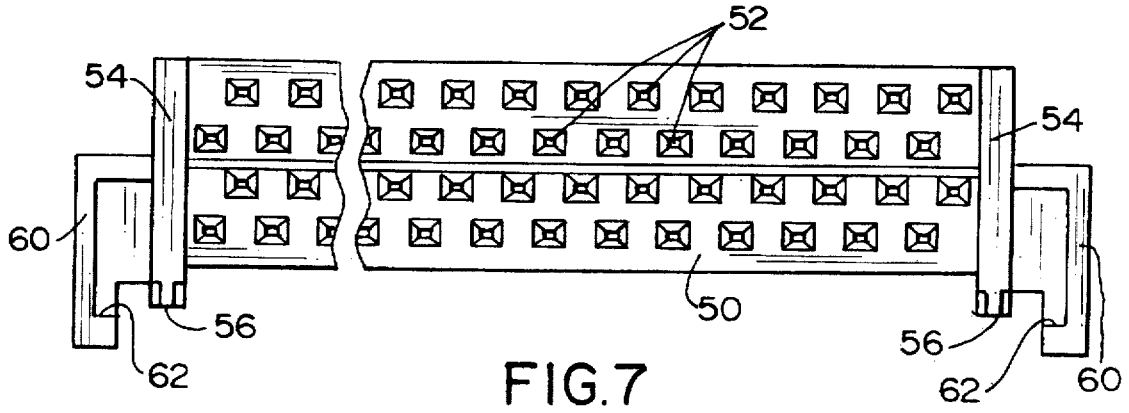
FIG. 7 is a top plan view of the tail aligning device.

Referring to FIGS. 6–9 in conjunction with FIGS. 1–5, tail aligning device 14 generally includes an elongated plate-like portion 50 having a plurality of apertures 52 through which circuit board mounting portions 40 of terminal tail portions 38 extend. FIGS. 5 and 6 best illustrate that the plate-like portion 50 has two horizontal levels generally corresponding to the vertical height of each groove 34, respectively. In the exemplary embodiment, two rows of apertures 52 set closer to the connector housing 12 are disposed in the lower level of plate-like portion 50 to receive the tail portions 38 of the terminals 16 with the contact portions 36 inserted into the lower grooves 34. Two rows of apertures 52 set farthest from the connector housing 12 are disposed in the higher level of the plate-like portion 50 to receive the tail portions 38 of the terminals 16 with the contact portions 36 inserted into the higher grooves 34. The tail aligning device has a pair of wing portions 54 near opposite ends thereof projecting generally transversely of rear face 20 of connector housing 12 to protect the tail portions of the terminals when the tail aligning device is mounted on the housing.

Wing portions 54 of tail aligning device 14 are formed as generally triangulated, planar gussets which not only protect terminals 16 but also provide strength and stability for the connector assembly including the connector housing. To that end, the gussets have a generally straight edge 56 which abuts generally straight or flat surface 58 (FIG. 2) at the groove 26 in rear face 20 of connector housing 12. Arms 60 at opposite ends of the tail aligning device have inwardly facing L-shaped hooks 62 such that the hooks embrace generally rectangular, downwardly projecting locking portion 25 of reduced size located at opposite ends 24 of the connector housing. These arms and hooks form complementary interengaging holding means for holding straight edges 56 of gussets 54 into abutting engagement with flat surfaces 58 on connector housing 12 such that the gussets not only rigidify tail aligning device 14, but the gussets are effective to stabilize the entire connector through the rigid abutting engagement between edges 56 and surfaces 58.

Figure 9:
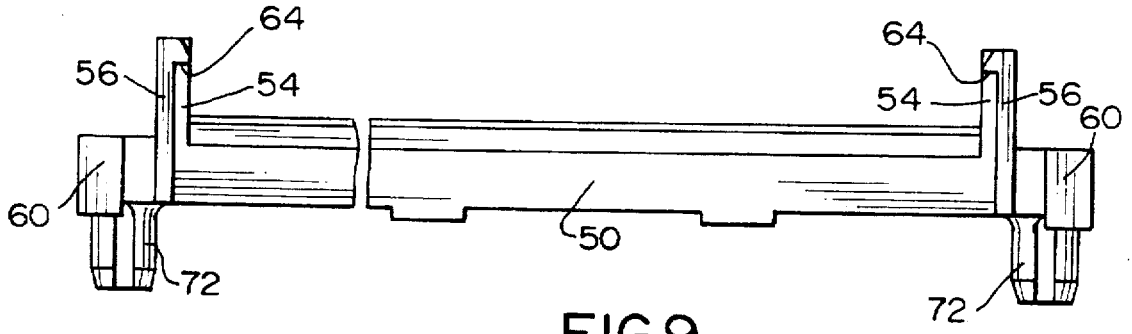
FIG. 9 is an elevational view of the side of the tail aligning device which mounts to the connector housing.
Figure 8:
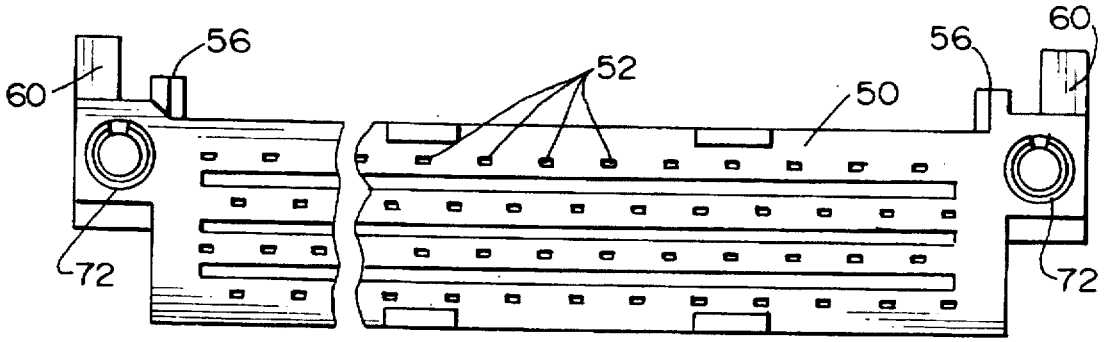
FIG. 8 a bottom plan view of the tail aligning device.

Generally, complementary interengaging snap-latch means are provided between tail aligning device 14 and housing 12 for mounting the tail aligning device on the housing automatically as the tail aligning device is moved to its fully operative mounted position. More particularly, as best seen in FIGS. 6 and 9, the tail aligning device includes a pair of ramped latches 64 facing inwardly of gussets 54 near straight edges 56 of the gussets. Tail aligning device 14 is mountable to connector housing 12 in the direction of arrows "C" (FIG. 2). As the tail aligning device is moved in its mounting direction, circuit board mounting portions 40 of terminal tail portions 38 enter apertures 52 in the tail aligning device. As the tail aligning device is moved to its fully mounted/operative position, the ramped surfaces on latches 64 engage the ramped surface on latch bosses 28 within grooves 26 at the rear face 20 of the connector housing and, eventually, the latches and latch bosses snap into latching engagement automatically due to the inherent resiliency of the molded dielectric components. In the fully assembled position, the top edges of arms 60 at the ends of the tail aligning device rigidly abut against the bottom surfaces of ends 24 of connector housing 12 to form a rigid mounting interface (as at 70 in FIG. 1).

Lastly, a pair of mounting pegs 72 are molded integrally with the bottom of tail aligning device 14. These pegs are adapted for insertion into mounting holes in an appropriate circuit board to which circuit board mounting portions 40 of the terminals are connected.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. An electrical connector, comprising:

an elongated dielectric housing having a front mating face and a rear face with a plurality of terminal-receiving passageways extending therebetween, the rear face extending between opposite ends of the housing, including grooves disposed vertically on the rear face of the housing, and said rear face being devoid of any substantial projections that would prevent a terminal-insertion tool that extends beyond at least one end of the housing from being moved into proximity with the rear face;

a plurality of terminals received in the passageways, each terminal including a forwardly projecting contact portion and a tail portion projecting rearwardly from the housing beyond said rear face thereof;

an elongated tail aligning device mountable on the housing and having a plurality of apertures through which the tail portions of the terminals extend, the tail aligning device having wing portions near opposite ends thereof for protecting the tail portions of the terminals, said tail aligning device including edges projecting generally transversely of the rear face of the housing to engage the grooves in the rear face of said housing; and said edge of said tail aligning device include a latch and said groove in the rear face of the housing each include a complementry interengaging latch boss for latching interengagment between the tail aligning device and the housing.

2. The electrical connector of claim 1, including complementary interengaging holding means between the tail aligning device and the housing for holding the edges of the tail aligning device in engagement with the grooves in the rear of the housing.

3. The electrical connector of claim 1 wherein said wing portions of the tail aligning device comprise generally planar gussets for stabilizing the connector.

4. The electrical connector of claim 3 wherein edges of said gussets are the edges of the tail aligning device engageable with the grooves in the rear face of the housing.

5. The electrical connector of claim 1 wherein the connector is a right-angled connector with the tail portions of the terminals including circuit board mounting portions at angles to said contact portions, the circuit board mounting portions extending through the apertures in the tail aligning device.

6. The electrical connector of claim 5 wherein said tail aligning device includes at least one mounting peg adapted for insertion into a mounting hole in an appropriate circuit board.

7. The electrical connector of claim 5 wherein said tail aligning device, including said wing portions thereof and said mounting post, comprises a one-piece molded dielectric component.

8. A right-angled electrical connector, comprising:

an elongated dielectric housing having a front mating face and a rear face with a plurality of terminal-receiving passageways extending therebetween, the rear face extending between and including opposite ends of the housing, including grooves vertically disposed therein and being devoid of any substantial projections which might prevent a terminal-insertion tool that extends beyond at least one end of the housing from being moved into proximity with the rear face;

a plurality of terminals received in the passageways, each terminal including a forwardly projecting contact portion and a tail portion projecting rearwardly from the housing beyond said rear face thereof, the tail portions including circuit board mounting portions at an angle to the contact portions;

an elongated tail aligning device mounted on the housing and having a plurality of apertures through which the circuit board mounting portions of the terminals extend, the tail aligning device having generally planar gussets near opposite ends thereof, said tail aligning device including edges projecting generally transversely of the rear face of the housing to engage the grooves in the rear face of said housing; and complementary interengaging snap-latch means between the tail aligning device and the housing for securing the tail aligning device on the housing automatically as the tail aligning device is moved to its fully operative position with the tail portions of the terminals in proper position in the apertures in the tail aligning device, said snap-latch means comprising edges of said tail aligning device including a latch and said grooves in the rear face of the housing each including a complementary interengaging latch boss for latching interengagment therebetween.

9. The right-angled electrical connector of claim 8 wherein said tail aligning device includes at least one mounting peg adapted for insertion into a mounting hole in an appropriate circuit board.

10. The right-angled electrical connector of claim 8 wherein said tail aligning device, including said gussets thereof and said mounting post, comprises a one-piece molded dielectric component.

11. The right-angled electrical connector of claim 8 wherein said rear face of said housing between and including said opposite ends is generally planar.

12. The right-angled electrical connector of claim 8 wherein edges of said gussets are the edges of the tail aligning device which engage the grooves in the rear face of the housing.

13. The right-angled electrical connector of claim 12, including complementary interengaging holding means between the tail aligning device and the housing for holding the edges of the gussets in engagement with the grooves in the rear face of the housing.

14. An electrical connector, comprising:

a dielectric housing having a generally planar rear face with grooves vertically disposed therein;

a plurality of terminals mounted on the housing and including tail portions projecting rearwardly of the rear face of the housing;

a tail aligning device mountable on the housing and having a plurality of apertures through which the tail portions of the terminals extend, the tail aligning device having support portions extending generally transversely of the rear face of the housing and edges for engaging the grooves in the rear face of the housing;

means for rigidly mounting the tail aligning device on the housing such that said support portions are effective to stabilize the housing as well as the tail aligning device; and said edges of said tail aligning device include a latch and said grooves in the rear face of the housing each include a complementary interengaging latch boss for latching interengagment between the tail aligning device and the housing.

15. The electrical connector of claim 14 wherein said support portions of the tail aligning device comprise generally planar gussets.

16. The electrical connector of claim 15 wherein edges of said gussets are the edges engageable with the grooves in the rear face of the housing.

17. The electrical connector of claim 16, including complementary interengaging holding means between the tail aligning device and the housing for holding the edges of the gussets in engagement with the grooves in the rear face of the housing.

* * * * *